United States Patent [19]

Mount et al.

[11] 4,404,811

[45] Sep. 20, 1983

[54] METHOD OF PREVENTING REFRIGERATION COMPRESSOR LUBRICATION PUMP CAVITATION

[75] Inventors: Gordon L. Mount, West Monroe; Benjamin F. Hesler, Canastota, both of N.Y.

[73] Assignee: Carrier Corporation, Syracuse, N.Y.

[21] Appl. No.: 325,615

[22] Filed: Nov. 27, 1981

[51] Int. Cl.[3] ..... F25B 43/02; G05D 23/32

[52] U.S. Cl. ..... 62/84; 62/157; 62/193; 62/217; 417/13

[58] Field of Search ..... 62/228 D, 228 C, 226, 62/217, 84, 192, 193, 196 C, 203, 204, 205, 206, 231, 157, 158, 224, 225, 468, 469; 417/281, 13

[56] References Cited

U.S. PATENT DOCUMENTS

| | | | |
|---|---|---|---|
| 2,983,111 | 5/1961 | Miner et al. | 62/115 |
| 3,200,603 | 8/1965 | Wake et al. | 62/84 |
| 3,408,827 | 11/1968 | Soumerai et al. | 62/196 R |
| 3,411,313 | 11/1968 | Brown et al. | 62/228 D |
| 3,508,416 | 4/1970 | Miller | 62/84 |
| 3,873,239 | 3/1975 | Jamieson | 417/281 |
| 4,080,110 | 3/1978 | Szymaszek | 417/280 |

*Primary Examiner*—Albert J. Makay
*Assistant Examiner*—Harry Tanner
*Attorney, Agent, or Firm*—Donald F. Daley; David L. Adour

[57] ABSTRACT

A method of regulating startup operation of a vapor compression refrigeration system to prevent oil pump cavitation during startup of the refrigeration system is disclosed. The method comprises monitoring the rate of decrease in evaporator pressure or temperature or monitoring compressor suction line pressure and then comparing this monitored rate to a rate of pressure or temperature decrease which is predetermined to prevent oil pump cavitation. If the monitored rate exceeds the predetermined rate control action is taken to adjust the capacity of the compressor to provide a desired rate of pressure drop which prevents oil pump cavitation. A microprocessor control system and a mechanical control system are disclosed for carrying out the disclosed method.

2 Claims, 4 Drawing Figures

METHOD OF PREVENTING REFRIGERATION COMPRESSOR LUBRICATION PUMP CAVITATION

BACKGROUND OF THE INVENTION

The present invention relates to methods of regulating the operation of vapor compression refrigeration systems, and more particularly relates to methods of regulating the startup operation of vapor compression refrigeration systems to prevent oil pump cavitation during startup of the refrigeration systems.

Vapor compression refrigeration systems of the hermetic type have an oil lubricated compressor transmission and an oil reservoir which is usually located in a housing for the transmission. An oil pump, having an inlet in the oil reservoir, pumps oil from the reservoir to the compressor transmission and bearings. During normal operation of the compressor, gaseous refrigerant in the transmission housing contacts the oil in the reservoir. To reduce compressor motor windage losses the gaseous refrigerant is maintained at relatively low pressure, during operation of the refrigeration system, by connecting the transmission housing through a pressure equalization line to the suction side of the compressor. The low pressure also reduces the amount of refrigerant absorbed into the oil during operation of the refrigeration system. However, during shutdown of a refrigeration system, the pressure in the oil reservoir rises and an increased amount of refrigerant is absorbed into the oil in the oil reservoir. The amount of refrigerant absorbed is a function of the pressure of the gaseous refrigerant above the oil in the reservoir and the temperature of the oil in the oil reservoir.

The oil in the reservoir may be heated to reduce the amount of refrigerant dissolved into the oil during shutdown. However, substantial quantities of refrigerant may dissolve into the oil during shutdown even if the oil is heated. Then, upon startup of the refrigeration system the pressure in the transmission housing is reduced and refrigerant dissolved in the oil separates from the oil creating a boiling type action. The pressure decrease is due to the connection of the suction of the compressor to the transmission housing through the pressure equalization line. The refrigerant boiling type action results in foaming of the oil and may result in the formation of vapor pockets at the inlet to the oil pump in the reservoir. This phenomenon is known as oil pump cavitation and is undesirable since it can prevent proper lubrication of the compressor transmission and bearings. Also, protective oil pressure sensing devices sense the pressure drop caused by the oil pump cavitation and may effect a shutdown of the refrigeration system.

Cycling timers which limit the rate of pulldown of refrigerant pressure in the evaporator of the refrigeration system during startup may be used to reduce oil pump cavitation. A fixed time period for controlling the position of inlet guide vanes to the compressor is set on the timer. The inlet guide vanes are controlled during the fixed time period to limit the rate of pressure drop in the evaporator and consequently reduce the boiling action of the gaseous refrigerant in the oil. Since the time period selected is fixed for all operating conditions, it is possible that oil pump cavitation may occur after the end of the fixed time period or that the rate of pulldown may be limited for a time period beyond the amount of time necessary to prevent oil pump cavitation.

Another device for reducing oil pump cavitation during startup is a differential oil pressure switch device. Usually, this type of device comprises two bellows, one of which is located in the oil circulation system, and the other of which is located at an inlet to the oil circulation system. When a pressure differential is detected indicating the occurrence of oil pump cavitation a control system responds to limit the rate of pulldown of refrigerant pressure in the evaporator of the refrigeration system. This type of differential oil pressure switch device is a relatively complex mechanical mechanism which is inherently subject to normal mechanical failure. Furthermore, this type of differential oil pressure switch device operates only after the onset of a cavitation condition and is not capable of preventing cavitation.

SUMMARY OF THE INVENTION

Therefore, an object of the present invention is to regulate the operation of a hermetic vapor compression refrigeration system during startup to prevent compressor lubrication pump cavitation.

Another object of the present invention is to regulate the startup operation of a hermetic vapor compression refrigeration system in an efficient, reliable, and relatively simple manner to prevent compressor lubrication pump cavitation.

These and other objects of the present invention are attained by regulating the refrigerant flow to a compressor of a hermetic, oil lubricated, vapor compression refrigeration system during startup, in response to a monitored pressure which is proportional to or corresponds to the vaporous refrigerant pressure above an oil reservoir of the lubrication system for the compressor. Preferably, the pressure in the evaporator or the pressure at the suction side of the compressor is monitored to determine the rate of pressure drop. This monitored rate of pressure decrease is compared to a pulldown rate which has been predetermined to prevent oil pump cavitation. An electrical signal is generated when the monitored rate exceeds the predetermined rate. Then, the monitored pressure decrease rate is adjusted by regulating the refrigerant flow to the compressor so that the corresponding rate of pressure decrease in the housing for the oil reservoir is reduced to a rate which prevents oil pump cavitation.

BRIEF DESCRIPTION OF THE DRAWINGS

Further objects and advantages of the present invention will be apparent from the following detailed description in conjunction with the accompanying drawings, in which.

DESCRIPTION OF THE PREFERRED EMBODIMENT

Figure 1:
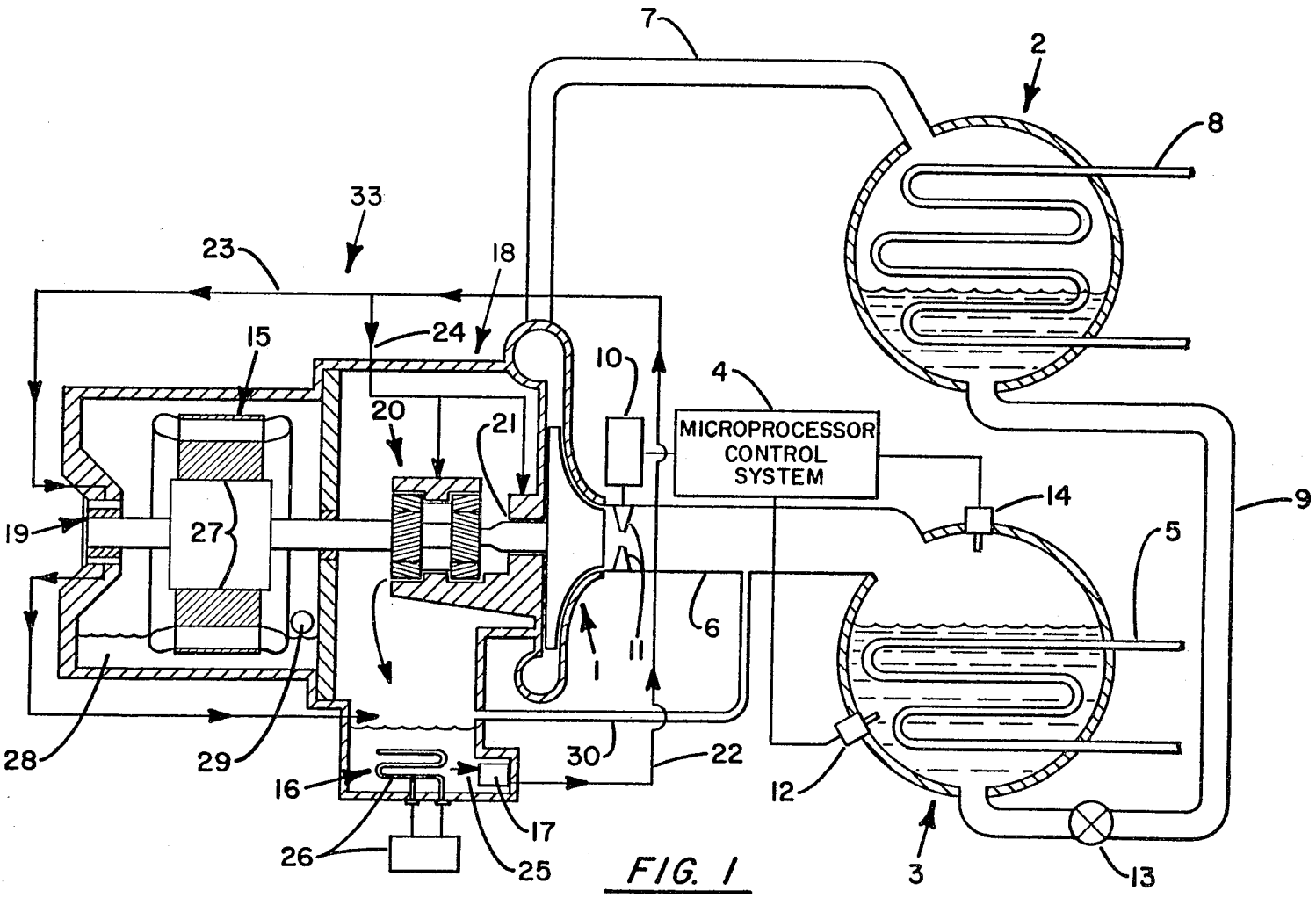
FIG. 1 is a schematic illustration of a vapor compression refrigeration system including a microprocessor control system capable of operation according to the principles of the present invention.

Referring to FIG. 1, a vapor compression refrigeration system is schematically illustrated which may be operated according to the principles of the present invention to prevent refrigeration compressor lubrication pump cavitation during startup of the refrigeration system. As shown in FIG. 1, the refrigeration system comrises a compressor 1, a condenser 2, and an evaporator 3. The condenser 2 and evaporator 3 are shell and tube type heat exchangers. In the evaporator 3, heat is transferred from a heat exchange medium, such as water, flowing through heat transfer tubing 5 to refrigerant in the evaporator 3 which is vaporized. The gaseous refrigerant from the evaporator 3 flows to the compressor 1 through a line 6. The compressor 1 has inlet guide vanes 11 which control the amount of refrigerant flow to the compressor 1. The gaseous refrigerant is compressed by the compressor 1 and passes through a line 7 to the condenser 2. In the condenser 2 heat is transferred from the refrigerant to a cooling medium flowing through tubing 8 thereby transforming the refrigerant to its liquid state. The liquid refrigerant from the condenser 2 passes to the evaporator 3 through line 9 and float valve 13 to complete the closed loop heat transfer cycle.

As illustrated in FIG. 1, a microprocessor control system 4 controls the operation of the refrigeration system. One function of the microprocessor 4 is to control the cooling capacity of the refrigeration system, in response to load conditions, by operating the inlet guide vane control mechanism 10 which opens and closes the inlet guide vanes 11 of the compressor 1. Normally, load conditions are determined by measuring the temperature of the heat exchange medium in the tubing 5.

However, for purposes of the present invention, in addition to load control temperature, the inputs to the microprocessor 4 include electrical signals indicating the pressure and/or temperature of the refrigerant in the evaporator 3. Alternatively, the suction pressure in the line 6 to the compressor may be monitored and corresponding electrical signals supplied to the microprocessor 4. As shown in FIG. 1, a temperature probe 12 and/or pressure sensor 14 located in the evaporator 3 may be used to provide an electrical signal to the microprocessor 4 indicating the temperature and/or pressure of the refrigerant in the evaporator 3. The temperature probe 12 may be a device such as a thermistor for monitoring the temperature of the liquid refrigerant in the evaporator 3. The pressure sensor 14 may be a device, such as a transducer strain gauge, for measuring the pressure of the gaseous refrigerant in the evaporator 3.

A motor 15 drives the compressor 1 through transmission 20 in housing 18. The compressor 1, the transmission 20 and motor 15 form an oil lubricated hermetic unit 33. The lubricating oil is pumped, by the operation of a pump 17, from an oil reservoir 16 located in the transmission housing 18 to the various components of the compressor 1, the transmission 20 and motor 15 which require lubrication. The oil reservoir 16 is vented to the suction side of the compressor 1 by a pressure equalization line 30. As shown in FIG. 1, motor end bearings 19, transmission 20, and journal bearings 21 of the hermetic unit 33 are oil lubricated. The lubricating oil enters oil lubrication circuits 22, 23, and 24 via an inlet 25 in the oil reservoir 16 and the oil from each lubrication circuit 22, 23 and 24 returns to the oil reservoir 16 by gravity feed.

Refrigerant from the refrigeration system is present within the transmission housing 18 due to gaseous refrigerant entering the housing 18 via pressure equalization line 30 from the suction side of the compressor 1. Motor cooling refrigerant enters the housing 18 through an inlet port (not shown) and, after passing through motor cooling passages 27, collects in a refrigerant reservoir 28. Refrigerant leaves the reservoir 28 via outlet port 29.

The pressure of the gaseous refrigerant above the oil reservoir 16 and the temperature of the oil in the oil reservoir 16 are the major factors determining the amount of refrigerant which is absorbed by the oil. The pressure of the gaseous refrigerant in the housing 18 depends on the pressure of the gaseous refrigerant on the suction side of the compressor 1. When the refrigeration system is operating, the compressor 1 reduces the pressure in suction line 6. This reduced pressure in line 6 produces a corresponding pressure reduction in transmission housing 18 and allows refrigerant to boil out of the oil in the oil reservoir 16. However, when the refrigeration system is not operating the pressure of the gaseous refrigerant above the oil reservoir 16 approaches ambient pressure thereby increasing the amount of refrigerant which is absorbed by the oil during shutdown. An oil heater 26 is provided to heat the oil in the oil reservoir 16 to prevent undesirable amounts of refrigerant from being absorbed into the oil during shutdown. However, substantial amounts of refrigerant may be absorbed by the oil even if the oil is heated.

When the refrigeration system is started, the guide vanes 11 in the compressor suction line 6 operate in response to the cooling requirements for the system and since cooling requirements are high at startup the guide vanes open and the pressure in the suction line 6 is reduced. The pressure of the gaseous refrigerant above the oil in the oil reservoir 16 is also reduced through line 30. This produces a boiling type action of the refrigerant in the oil in the oil reservoir 16. Vigorous boiling action produces foaming and vapor pockets in the oil reservoir 16 at the inlet 25 to the oil pump 17 thereby causing oil pump cavitation. These vapor pockets may momentarily result in a substantial reduction in oil pressure in the oil lubrication circuits 22, 23 and 24 which may prevent proper lubrication of the compressor. If there are protective systems monitoring the oil pressure in the lubrication circuits 22, 23 and 24, a decrease in lubricant pressure will cause these systems to respond to shut down the refrigeration system resulting in a recycling of the system which reduces overall operating efficiency.

By operating the refrigeration system according to the principles of the present invention, oil pump cavitation and the resulting recycling of the system is prevented. Specifically, the inlet guide vanes 11, which are controlled by the inlet guide vane control mechanism 10, may be opened, during startup, at a rate which is controlled by the microprocessor 4 to prevent oil pump cavitation rather than to meet load requirements. In effect, the normal operation of the refrigeration system is overridden, if necessary, during startup to prevent oil pump cavitation. It should be noted that controlling the rate of pulldown during startup, according to the principles of the present invention, has other advantages besides preventing oil pump cavitation and resulting refrigeration system shutdown and recycling. For example, energy savings may result because of a reduced peak power demand by the system at startup and because of efficiencies obtained by reducing part-load operating time.

For purposes of performing the override operation the microprocessor 4 continuously receives electrical signals during startup indicating the temperature or pressure of the refrigerant in the evaporator 3 from the temperature probe 12 or the pressure sensor 14. Alternatively, the pressure in the suction line 6 may be monitored. The microprocessor electronically determines the rate at which the refrigerant pressure in the evaporator 3 decreases, based on the pressure or temperature measurements as a function of time. This actual rate of pulldown of the pressure in the evaporator is electronically compared, by the microprocessor 4, to a rate which has been predetermined to provide a rate of pulldown of refrigerant pressure in the evaporator 3 which will prevent oil pump cavitation. The predetermined pulldown rate is programmed into the microprocessor 4 and the required comparison functions are built into the microprocessor 4 in the conventional manner. The control mechanism 10 is operated in response to an electrical output signal from the microprocessor 4 to control the closing and opening of the guide vanes 11 to achieve the predetermined pulldown rate.

One way of controlling the guide vanes 11 is to open the vanes in stages during startup rather than immediately fully opening the guide vanes 11 in response to the load requirements of the refrigeration system. According to this control scheme the vanes 11 are at a minimum opening size at startup and after a selected amount of time are opened slightly to a larger, first stage, opening size. The microprocessor 4 monitors the actual rate of pressure drop and compares it to the predetermined rate after the first stage of opening of the guide vanes 11. When the microprocessor determines that the actual pulldown rate is equal to or less than the predetermined rate the guide vanes are opened an additional amount to a second stage opening size. The microprocessor 4 continues to monitor the actual pulldown rate and compare it to the predetermined rate and repeats the previously described control function to open the guide vanes in further stages. In this manner, the inlet guide vanes 11 are opened to full capacity in the minimum time possible without excessive pressure drops.

After the startup period, the microprocessor 4 controls the guide vanes 11 totally in response to cooling load requirements of the refrigeration system. This is possible since enough refrigerant will have boiled out of the oil in the oil reservoir 16 during the startup period so that oil pump cavitation is no longer a problem. Of course, other methods of controlling the opening and closing of the guide vanes 11 are possible under the principles of the present invention. The critical factor is that the guide vanes 11 be controlled, during startup, to regulate the refrigerant pressure in the evaporator 3, and, therefore, also in the housing 18, to prevent cavitation problems.

The optimal refrigerant pressure pulldown rate is that rate which provides the fastest refrigeration system cooling capacity increase which may be maintained without causing a cavitation problem. This optimal pulldown rate is based on experience in operating a particular refrigeration system. The optimal rate varies depending on the amount of oil stored in the oil reservoir 16, the kind of refrigerant used in the refrigeration system, the temperature of the oil in the oil reservoir 16 at startup of the refrigeration system and other such factors.

Figure 2:
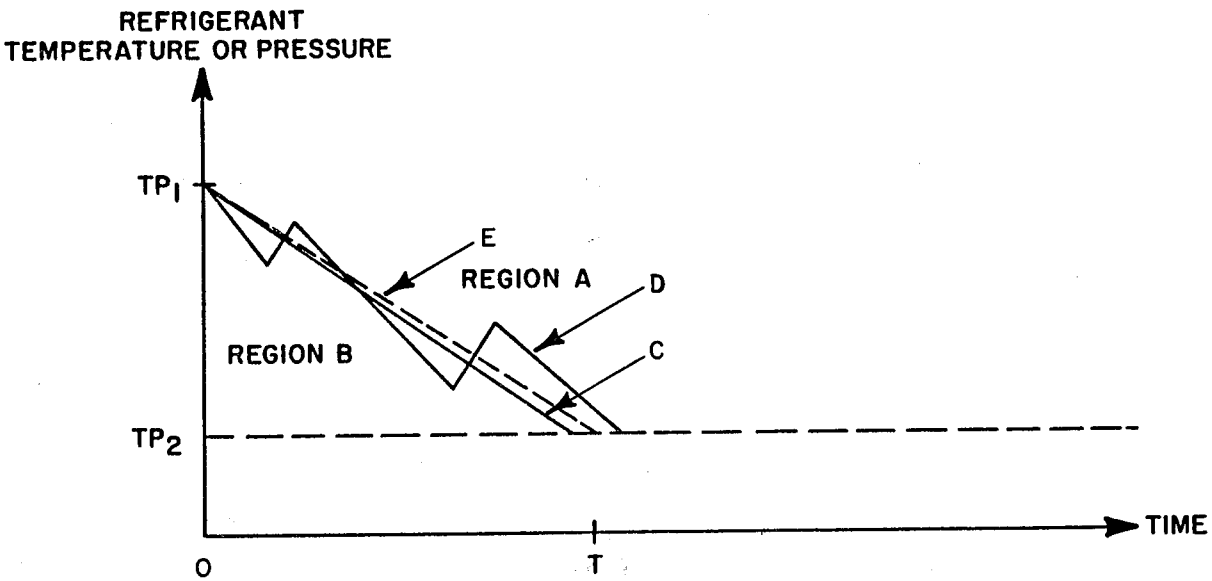
FIG. 2 is a graph of refrigerant pressure (or equivalently refrigerant temperature) in the evaporator of a refrigeration system as a function of time after startup of the refrigeration system. The curves shown in this Figure correspond to an optimal rate, a preferable rate, and a differential oil pressure system rate of evaporator refrigerant pressure pulldown for an ideal vapor compression refrigeration system such as depicted in FIG. 1.

Referring to FIG. 2, a solid straight-line curve C is shown which represents an idealized optimal pulldown rate for preventing oil pump cavitation during startup of the vapor compression refrigeration system depicted in FIG. 1. The curve C is a graphic representation of a predetermined pulldown rate which may be electronically preprogrammed into the microprocessor 4. This optimal pulldown rate is the fastest pulldown rate allowable which will still prevent an oil pump cavitation problem. As shown in FIG. 2, $TP_1$ represents the temperature or pressure of the refrigerant in the evaporator 3 at startup, which is designated as time zero. $TP_2$ represents the temperature or pressure of the refrigerant in the evaporator 3 at the end of the startup period when the pressure of the gaseous refrigerant in the housing 18 above the oil reservoir 16 has been reduced to a level whereby enough refrigerant has boiled out of the oil in the oil reservoir 16 so that oil pump cavitation is no longer a problem.

The magnitude of the optimal pulldown rate corresponds to the slope of the solid straight-line curve C shown in FIG. 2 and, since the curve shown is a straight line, this slope represents a fixed constant pulldown rate. The optimal pulldown rate may be a non-constant function of time and such a non-constant pulldown rate would be represented by a curve with a non-constant slope. Any straight-line curve which falls in region B, below the curve shown in FIG. 2, represents a pulldown rate at which oil pump cavitation may occur and represents a rate which is greater than the optimal rate represented by the curve C. The solid sawtooth curve D shown in FIG. 2 represents a pulldown rate which might be achieved with a differential oil pressure switch device of the type described previously in the "Background of the Invention" section. As shown in FIG. 2 this sawtooth curve C has straight-line sections falling below the optimal solid straight-line curve C thereby indicating that such a differential oil pressure switch device may allow cavitation to occur. Any straight line curve which falls in region A, above the curve C shown in FIG. 2, represents a pulldown rate which prevents oil pump cavitation but which is less than the optimal rate represented by the curve C.

It is most desirable to operate the refrigeration system so that the optimal rate of pulldown is achieved. However, in an actual operating environment it may be preferable to select a pulldown rate, for the predetermined rate, which is slightly less than the optimal rate to prevent oil pump cavitation from occurring even if uncontrollable variables cause the optimal rate to change from one startup to another. Such a preferable rate is shown by the dashed line curve E of FIG. 2.

Further referring to FIG. 2, time T represents the amount of time after startup to reach the $TP_2$ level from the $TP_1$ level when the preferable pulldown rate is maintained and, time T corresponds to the amount of time the primary chilled water temperature control function of the microprocessor 4 is overridden during startup to prevent oil pump cavitation. A fixed constant rate of pulldown, approximately equal to the optimal rate, usually is selected as the preferable pulldown rate which is programmed into the microprocessor 4 as the predetermined rate. A non-constant predetermined rate of pulldown as a function of time may be selected if the optimal rate is non-constant and it is desired to closely approximate this non-constant optimal rate.

Once a predetermined rate is selected the refrigeration system is operated during each startup to prevent oil pump cavitation as described previously. This result is efficiently achieved regardless of the startup refrigerant temperature or pressure $TP_1$ since during each startup the optimal pulldown rate is closely approximated according to the principles of the present invention. In effect, the amount of time T during which the load control function is overridden varies as a function of startup temperature or pressure. This type of operation minimizes the amount of time T during which the load control function of the microprocessor 4 is overridden during each startup. This is quite unlike the operation of a cycling timer which limits the rate of pulldown for the same fixed amount of time at each startup regardless of startup conditions.

Figure 3:
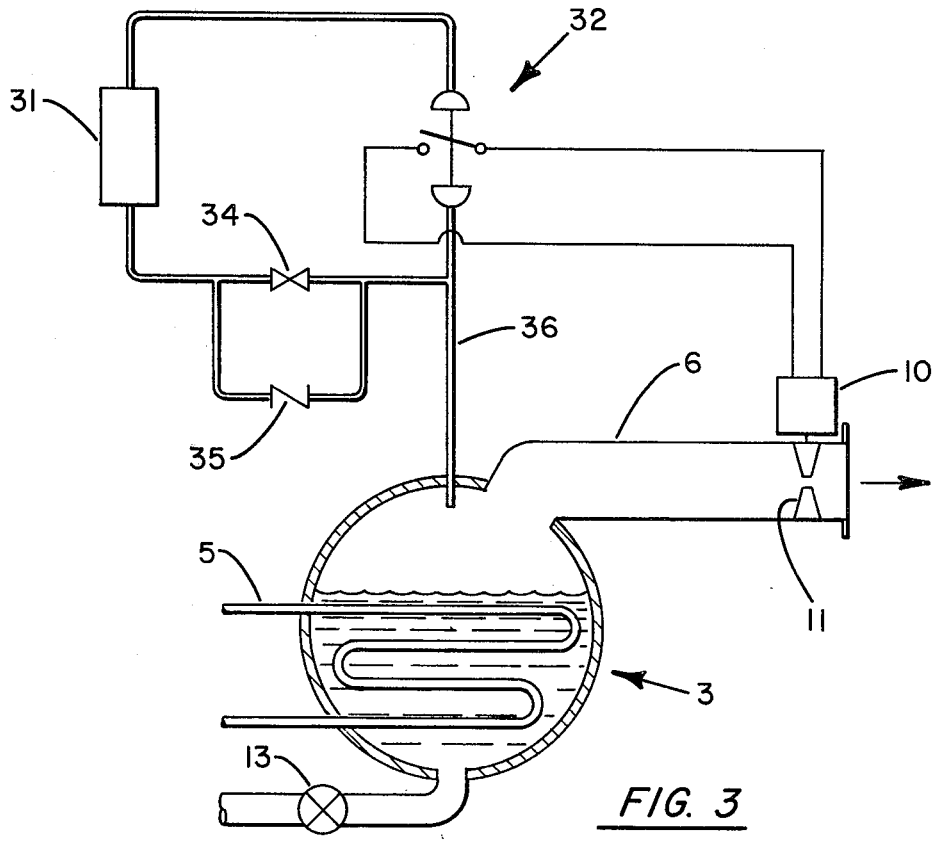
FIG. 3 is a schematic illustration of a mechanical control system for regulating the startup operation of a refrigeration system, such as shown in FIG. 1, to prevent compressor oil pump cavitation according to the principles of the present invention.

Referring to FIG. 3 part of a vapor compression refrigeration system, such as shown in FIG. 1, is schematically illustrated having a mechanical control system for regulating the startup operation of the refrigeration system to prevent compressor oil pump cavitation according to the principles of the present invention. Elements shown in FIG. 3 which also are shown in FIG. 1 and which have been described previously in connection with FIG. 1 are designated by the same reference numerals in FIG. 3 as in FIG. 1. It should be noted that the mechanical control system shown in FIG. 3 is distinct from the microprocessor control system of FIG. 1 and may be used to retrofit a refrigeration system which does not have a microprocessor so that the refrigeration system may be operated during startup according to the principles of the present invention.

Figure 4:
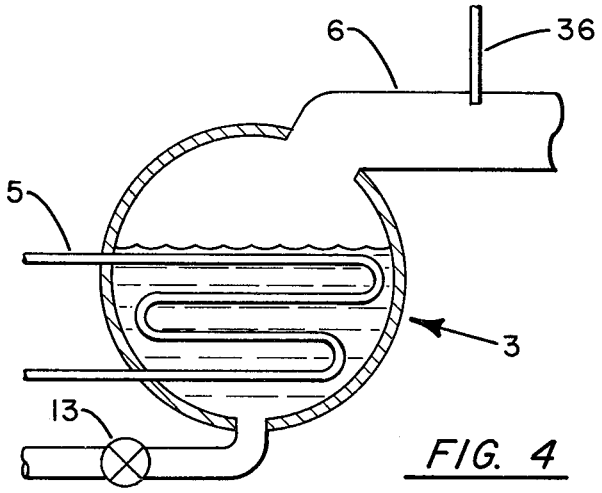
FIG. 4 is a schematic illustration of an alternative location for connection of the conduit 36 shown in FIG. 3.

As shown in FIG. 3, the mechanical control system comprises a volume or vaporous refrigerant reservoir 31; a differential pressure switch 32, a restrictor valve 34, and a check valve 35. One side of the switch 32 is connected to the volume 31 to monitor the fluid pressure in the volume. The other side of the switch 32 is connected by conduit 36 to the evaporator 3 to monitor the gaseous refrigerant pressure in the evaporator 3. Alternatively, if desired, the conduit 36 may be connected to the suction line 6 for the compressor 1 as shown in FIG. 4. Restrictor valve 34 and check valve 35 are connected in parallel between the volume 31 and the conduit 36 to allow gaseous refrigerant to flow between the volume 31 and the evaporator 3 depending on the pressure difference between the gaseous refrigerant in the volume 31 and in the evaporator 3. The check valve 35 allows gaseous refrigerant to flow relatively freely from the evaporator 3 to the volume 31 when the pressure in the evaporator 3 exceeds the pressure in the volume 31. However, when the pressure in the evaporator 3 is less than the pressure in the volume 31 then the check valve 35 closes to prevent flow through the valve 35. The differential pressure switch 32 provides an electrical signal to the guide vane control mechanism 10 when the pressure on the volume 31 side of the switch 32 exceeds the pressure on the conduit 36 side of the switch 32 by a selected amount.

In operation, when the refrigeration system is shut down the pressure of vaporous refrigerant in the evaporator 3 increases to a relatively high level compared to the pressure of the vaporous refrigerant in the volume 31. The check valve 35 is opened due to the pressure difference and gaseous refrigerant rapidly flows from the evaporator 3 through the conduit 36 to the volume 31 until the pressure in the volume 31 approximately equals the pressure in the evaporator 3. Then, when the refrigeration system is started, the pressure in the evaporator 3 drops thereby closing the check valve 35. The gaseous refrigerant trapped in the volume 31 gradually flows through the restrictor valve 34 to the evaporator 3 until the pressure equalizes across the valve 34. Correspondingly, the pressure on the volume 31 side of the switch 32 decreases in response to the decrease in pressure in the volume 31. Also, the pressure on the conduit 36 side of the switch 32 decreases in response to the decrease in pressure in the evaporator 3. The size of the volume 31 and the size of the opening of the restrictor valve 34 are selected to provide a rate of pressure decrease in the volume 31 which corresponds to a pressure drop in the evaporator 3 and housing 18 which prevents oil pump cavitation. If the pressure in the evaporator 3 drops too rapidly, that is, if the pressure drops so rapidly that oil pump cavitation may occur, then the switch 32 senses a pressure differential which causes switch 32 to close to supply an electrical signal to the guide vane control mechanism 10. The mechanism 10 is activated by the electrical signal to adjust the flow rate of gaseous refrigerant to the compressor to reduce the rate of pressure decrease in the evaporator 3 to a level at which oil pump cavitation is no longer a problem. Preferably, the size of the volume 31 and size of the opening of the restrictor valve 34 are selected so that control action is initiated before the onset of cavitation.

It should be noted that, for certain refrigeration systems, it may be desired to connect the restrictor valve 34 and check valve 35 directly to the evaporator 3 or suction line 6 rather than to indirectly connect these valves 34 and 35 via conduit 36 to the evaporator 3 or suction line 6. This direct connection requires that two separate lines be constructed connecting the mechanical control mechanism to the evaporator 3 or suction line 6. However, direct connection may be preferred to avoid undesirable pressure variations on the evaporator 3 side of the switch 32 which are due to the flow of gaseous refrigerant from the volume 31 through the restrictor valve 34 to the conduit 36. The effects of these pressure variations may be negligible depending on the size of conduit 36, the magnitude of the flow and the operating characteristics of the particular refrigeration system. However, the direct connection of the valves 34 and 35 to the evaporator 3 or suction line 6 avoids the effects of such pressure variations.

Finally, while the present invention has been described in conjunction with particular embodiments it is to be understood that various modifications and other embodiments of the present invention may be made without departing from the scope of the invention as described herein and as claimed in the appended claims.

What is claimed is:

1. A method of regulating start-up operation, to prevent oil pump cavitation, of a hermetically sealed refrigeration system of the type wherein a lubricating oil reservoir is located in a housing filled with vaporous refrigerant at a pressure proportional to the refrigerant pressure in the refrigeration system evaporator, comprising:

measuring the pressure in the evaporator;

comparing the measured pressure in the evaporator to a pressure which corresponds to a desired predetermined rate of pressure drop for the evaporator;

generating an electrical signal when the pressure drop in the evaporator exceeds the predetermined rate; and controlling the rate of pressure drop in the evaporator, in response to the generated electrical signals, so that the pressure drop in the evaporator approximately equals the predetermined rate.

2. A method of controlling the operation of a refrigeration system to prevent cavitation of an oil pump located in a lubricating oil reservoir in a housing filled with vaporous refrigerant at a pressure determined by the suction pressure of the refrigeration system compressor comprising the steps of:

monitoring the suction pressure of vaporous refrigerant to the compressor during start-up of the compressor to determine the rate of suction pressure drop, comparing the suction pressure to a pressure which corresponds to a predetermined rate at which pressure may drop during start-up of the compressor without causing oil pump cavitation, generating an electrical signal when the rate at which the suction pressure drops increases above the predetermined rate, and restricting flow of vaporous refrigerant to the compressor in response to the electrical signal.

* * * * *